US011566875B1

(12) United States Patent
Spikes

(10) Patent No.: US 11,566,875 B1
(45) Date of Patent: Jan. 31, 2023

(54) AUTOMATED TARGET SYSTEMS

(71) Applicant: Larry W. Spikes, Marshall, TX (US)

(72) Inventor: Larry W. Spikes, Marshall, TX (US)

( * ) Notice: Subject to any disclaimer, the term of this patent is extended or adjusted under 35 U.S.C. 154(b) by 139 days.

(21) Appl. No.: 17/181,695

(22) Filed: Feb. 22, 2021

(51) Int. Cl.
*F41J 7/04* (2006.01)

(52) U.S. Cl.
CPC ..... *F41J 7/04* (2013.01)

(58) Field of Classification Search
CPC ..... F41J 7/04
See application file for complete search history.

(56) References Cited

U.S. PATENT DOCUMENTS 4,540,182 A * 9/1985 Clement ..... F41J 7/04 273/391
4,732,394 A * 3/1988 Stein ..... F41J 7/04 273/391
4,979,752 A 12/1990 Fosseen
5,240,258 A * 8/1993 Bateman ..... F41J 1/10 273/392
7,052,012 B2 * 5/2006 Dehart ..... F41J 7/00 273/354
7,201,376 B2 4/2007 Kuosa
7,694,973 B1 * 4/2010 Hofmeister ..... F41J 7/06 273/391
8,235,390 B1 8/2012 Spikes
8,608,169 B2 * 12/2013 Saunders ..... F41J 7/04 273/392
11,391,548 B1 * 7/2022 Woitas ..... F41J 7/04
2016/0195369 A1 * 7/2016 Perry ..... F41J 7/04 273/386
2022/0236039 A1 * 7/2022 Johnson ..... F41J 7/04

* cited by examiner

*Primary Examiner* — Laura Davison
(74) *Attorney, Agent, or Firm* — R. Keith Harrison

(57) ABSTRACT

Automated target systems may include a system base. A target plate may be pivotally carried by the system base. The target plate may be deployable in an erect, pre-struck position and a fallen, post-struck position. A target return assembly may engage the target plate. The target return assembly may be operable to deploy the target plate from a fallen, post-struck position to an extended target return configuration after the target plate is struck by a projectile.

16 Claims, 11 Drawing Sheets

AUTOMATED TARGET SYSTEMS

FIELD

Illustrative embodiments of the disclosure generally relate to firearms, and more particularly, to automated target systems in which a target plate assumes a falling motion upon completion of a successful shooting attempt and then automatically assumes an erect, pre-struck position for each subsequent shooting attempt.

SUMMARY

Illustrative embodiments of the disclosure are generally directed to automated target systems in which a target plate assumes a falling motion upon completion of a successful shooting attempt and then automatically assumes an erect, pre-struck position for each subsequent shooting attempt. An illustrative embodiment of the automated target systems may include a system base. A target plate may be pivotally carried by the system base. The target plate may be deployable in an erect, pre-struck position and a fallen, post-struck position. A target return assembly may engage the target plate. The target return assembly may include a target return motor. A drive disk may be drivingly engaged for rotation by the target return motor. An arm linkage may have a proximal linkage end rotatably engaged by the drive disk in off-center relationship to the drive disk and a distal linkage end opposite the proximal linkage end. A target actuating arm may have a proximal arm end rotatably engaged by the arm linkage at the distal linkage end and a distal arm end opposite the proximal arm end. The arm linkage and the target actuating arm may be configurable from a retracted home configuration in which the distal arm end of the target actuating arm disengages the target plate in the fallen, post-struck position to an extended target return configuration in which the distal arm end of the target actuating arm engages and pushes the target plate from the fallen, post-struck position to the erect, pre-struck position responsive to operation of the target return motor. At least one motion sensor may be disposed in motion-sensing proximity to the target plate. At least one power supply may electrically interface with the target return motor and the at least one motion sensor.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
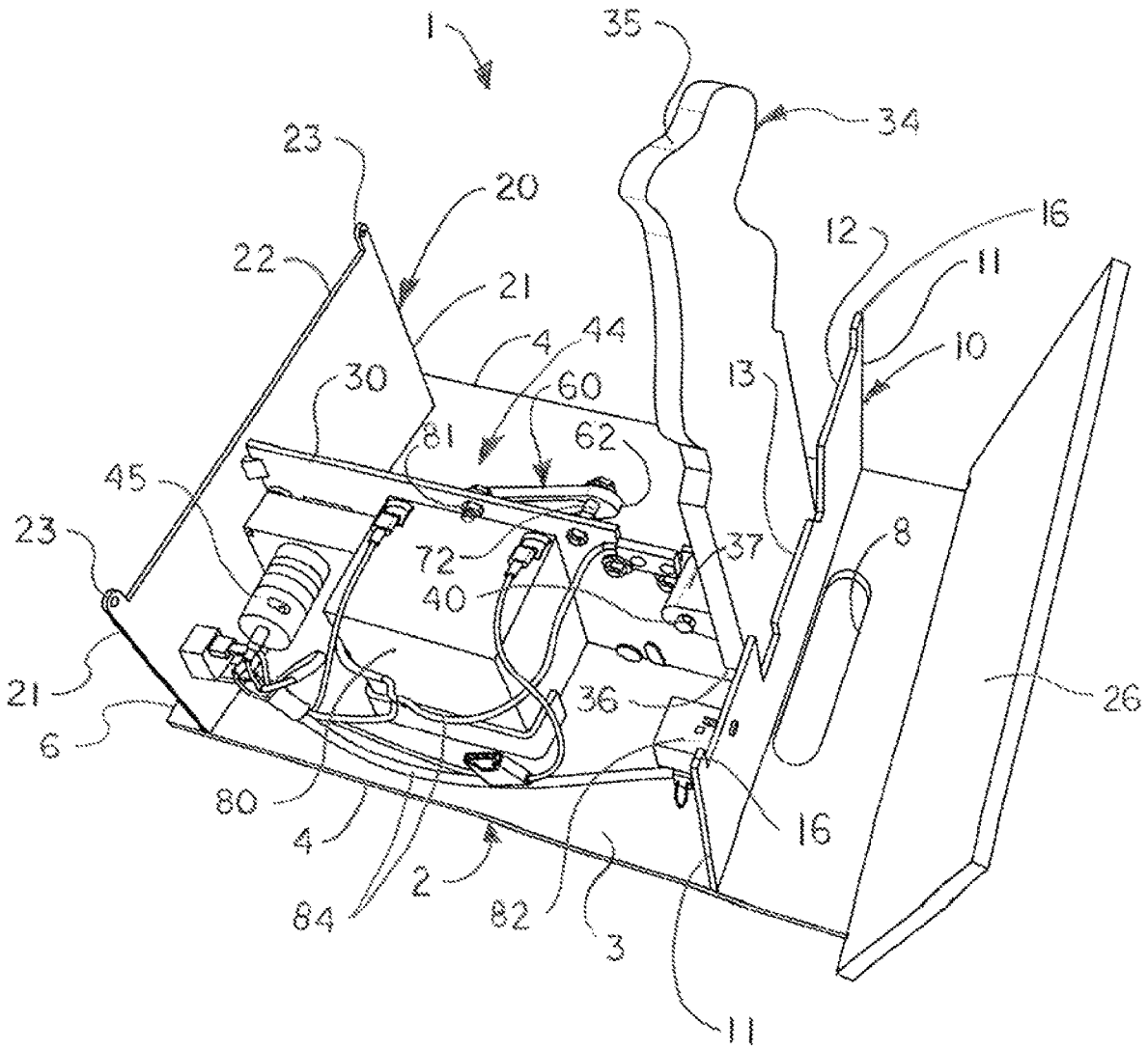
FIG. 1 is a right-side perspective view of an illustrative embodiment of the automated target systems, with a system cover removed for clarity, more particularly illustrating the target plate of the automated target system deployed in the erect, pre-struck position.
Figure 2:
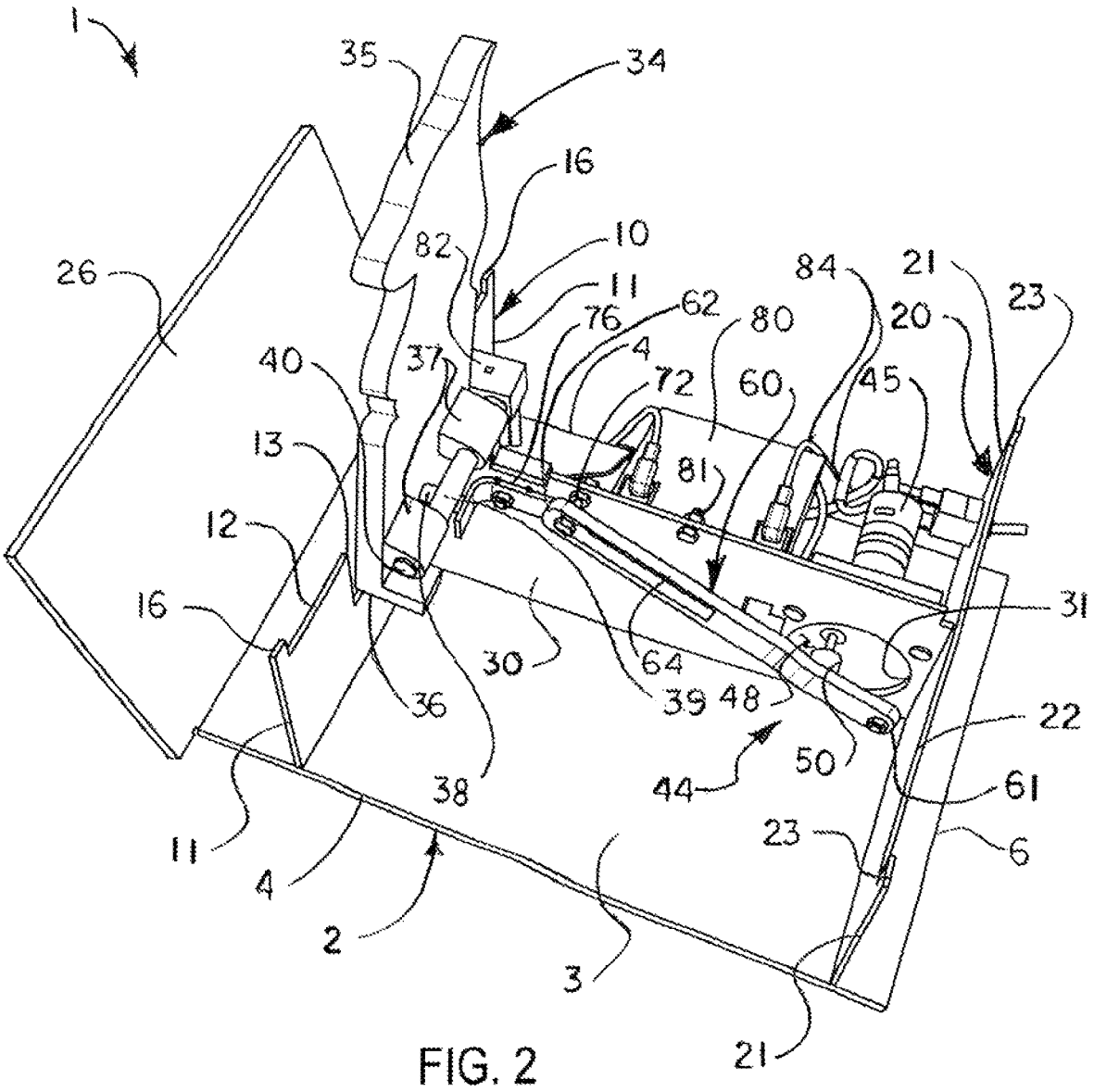
FIG. 2 is a left side perspective view of the illustrative automated target system with the system cover removed and the target plate deployed in the pre-struck position.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower" "left", "rear". "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring initially to FIGS. 1-12 of the drawings, an illustrative embodiment of the automated target system is generally indicated by reference numeral 1. The automated target system 1 may include a system base 2. A target plate 34 may be pivotally mounted on the system base 2. The target plate 34 may be deployable in an erect, upright, pre-struck position (FIGS. 1-4) and a fallen, post-struck position (FIGS. 5 and 7) on the system base 2. Accordingly, in typical application of the automated target system 1, which will be hereinafter described, a shooter (not illustrated) of a firearm may fire a round from the firearm toward the erect target plate 34 from a distance in a shooting attempt. If the fired round strikes the target plate 34, the target plate 34 may fall from the erect, pre-struck position to the fallen, post-struck position due to the traveling motion of the projectile. As illustrated in FIGS. 6-12, a target return assembly 44 may be configured to engage and return the target plate 34 from the fallen, post-struck position back to the erect, pre-struck position after the fired round strikes the target plate 34, typically as will be hereinafter described.

The system base 2 of the automated target system 1 may have any design which is suitable for supporting the target plate 34, the target return assembly 44 and other components of the automated target system 1. In some embodiments, the system base 2 may include a base plate 3. A front base panel 10 and a rear base panel 20 may extend upwardly from the base plate 3 in spaced-apart relationship to each other. The base plate 3 may be elongated and rectangular with a pair of elongated, parallel, spaced-apart side plate edges 4. A front plate edge 5 and a rear plate edge 6 may extend between the side plate edges 4. The front base panel 10 and the rear base panel 20 may extend from the base plate 3 proximate the front plate edge 5 and the rear plate edge 6, respectively, thereof.

In some embodiments, the front base panel 10 of the system base 2 may have a pair of parallel, spaced-apart front panel side edges 11. The front base panel 10 may have a width such that the front panel side edges 11 may be flush with the respective side plate edges 4 of the base plate 3. A front panel upper edge 12 may extend between the front panel side edges 11. In some embodiments, a target plate notch 13 may be provided in the front panel upper edge 12. The target plate notch 13 may be suitably sized and configured to receive or accommodate at least a portion of the target plate 34 in the fallen, post-struck position of the target plate 34, typically as will be hereinafter described. A pair of spaced-apart front panel tabs 16 may extend from the front panel upper edge 12 on respective sides of the target plate notch 13 for purposes which will be hereinafter described.

In some embodiments, the rear base panel 20 of the system base 2 may have a pair of parallel, spaced-apart rear panel side edges 21. The rear base panel 20 may have a width such that the rear panel side edges 21 of the rear base panel 20 may be flush with the respective side plate edges 4 of the base plate 3. A rear panel upper edge 22 may extend between the rear panel side edges 21. A pair of spaced-apart rear panel tabs 23 may extend from the rear panel upper edge 22 for purposes which will be hereinafter described.

In some embodiments, a deflection panel 26 may extend from the base plate 3 of the system base 2 typically at or adjacent to the front plate edge 5 and forwardly of the front base panel 10. The deflection panel 26 may angle upwardly in the forward direction from the base plate 3. In typical application of the automated target system 1, which will be hereinafter described, the deflection panel 26 may deflect rounds (not illustrated) which may have a trajectory which falls below the target plate 34 to deflect the rounds into the ground and prevent ricochet of the rounds toward the shooter.

Figure 3:
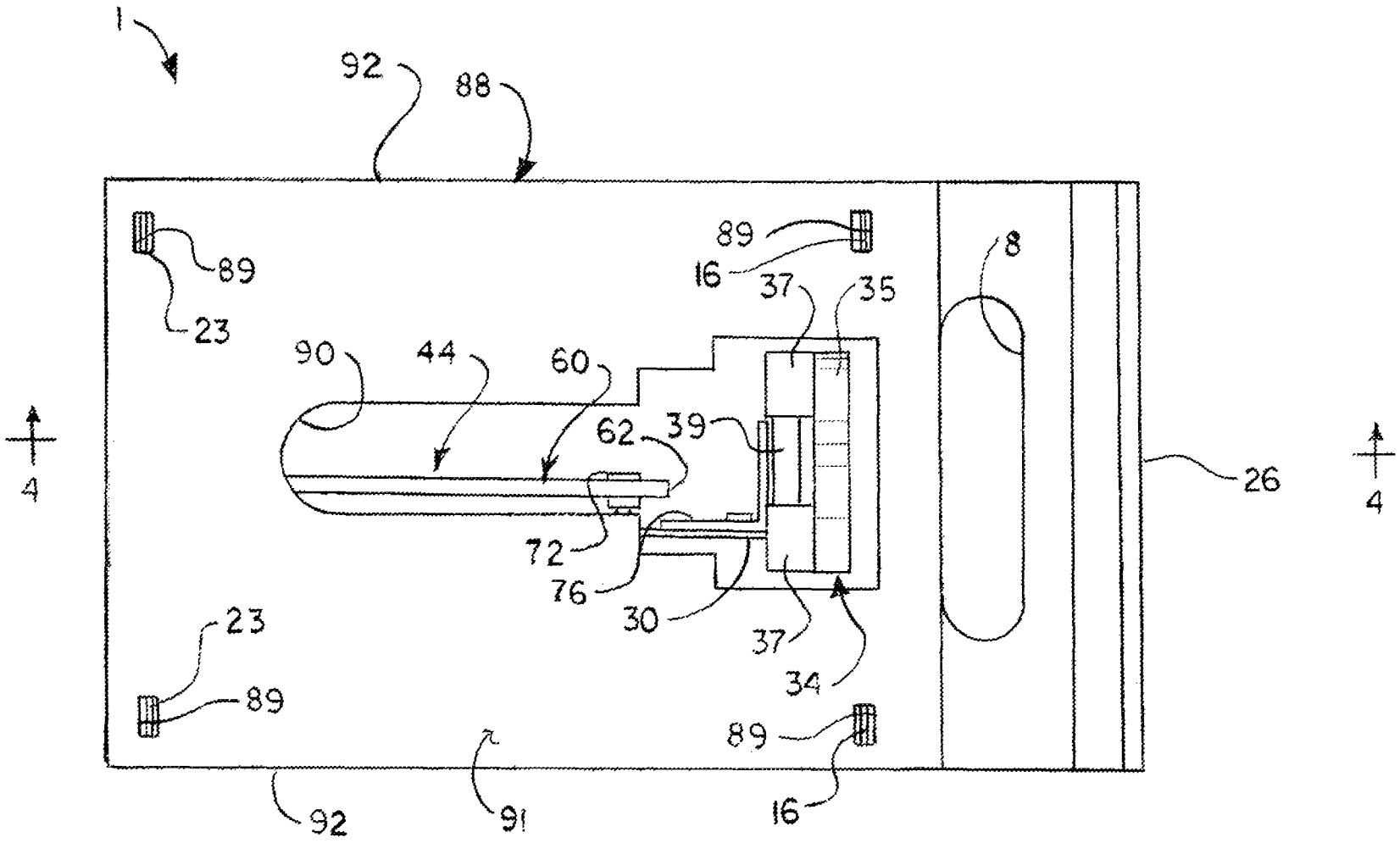
FIG. 3 is a top view of the illustrative automated target system with the system cover deployed in place.

As illustrated in FIGS. 1 and 3, in some embodiments, at least one handle slot 8 may extend through the base plate 3 of the system base 2 for carrying and/or positioning purposes. The handle slot 8 may be provided between the front base panel 10 and the deflection panel 26, as illustrated, for example and without limitation.

In some embodiments, a base partition 30 may extend upwardly from the base plate 3 and span the front base panel 10 to the rear base panel 20 of the system base 2. The base partition 30 may be configured to support the various components of the target return assembly 44, typically as will be hereinafter described. As illustrated in FIGS. 6-10, in some embodiments, a partition opening 31 may extend through the base partition 30 for purposes which will be hereinafter described.

The target plate 34 may include a target portion 35. The target portion 35 may include steel, aluminum, composite materials and/or other material which is suitable for being struck by a fired projectile. In some embodiments, the target portion 35 may resemble the size and/or shape any desired animal or object. For example and without limitation, in some embodiments, the target portion 35 of the target plate 34 may resemble the side or profile of a rabbit, squirrel or other game animal. The target portion 35 of the target plate 34 may have a lower target portion edge 36.

The target portion 35 of the target plate 34 may be pivotally attached to the system base 2 according to the knowledge of those skilled in the art. Accordingly, as particularly illustrated in FIG. 2, in some embodiments, a target mount bushing 39 may be provided on the base partition 30, for example and without limitation. A pair of spaced-apart target mount flanges 37 may extend from the target portion 35 of the target plate 34. The target mount flanges 37 may be disposed in alignment or registration with and on opposite sides of the target mount bushing 39. A target pivot pin 40 may extend through the target mount flanges 37 and the registering target mount bushing 39 to pivotally mount the target plate 34 with respect to the base partition 30.

Figure 6:
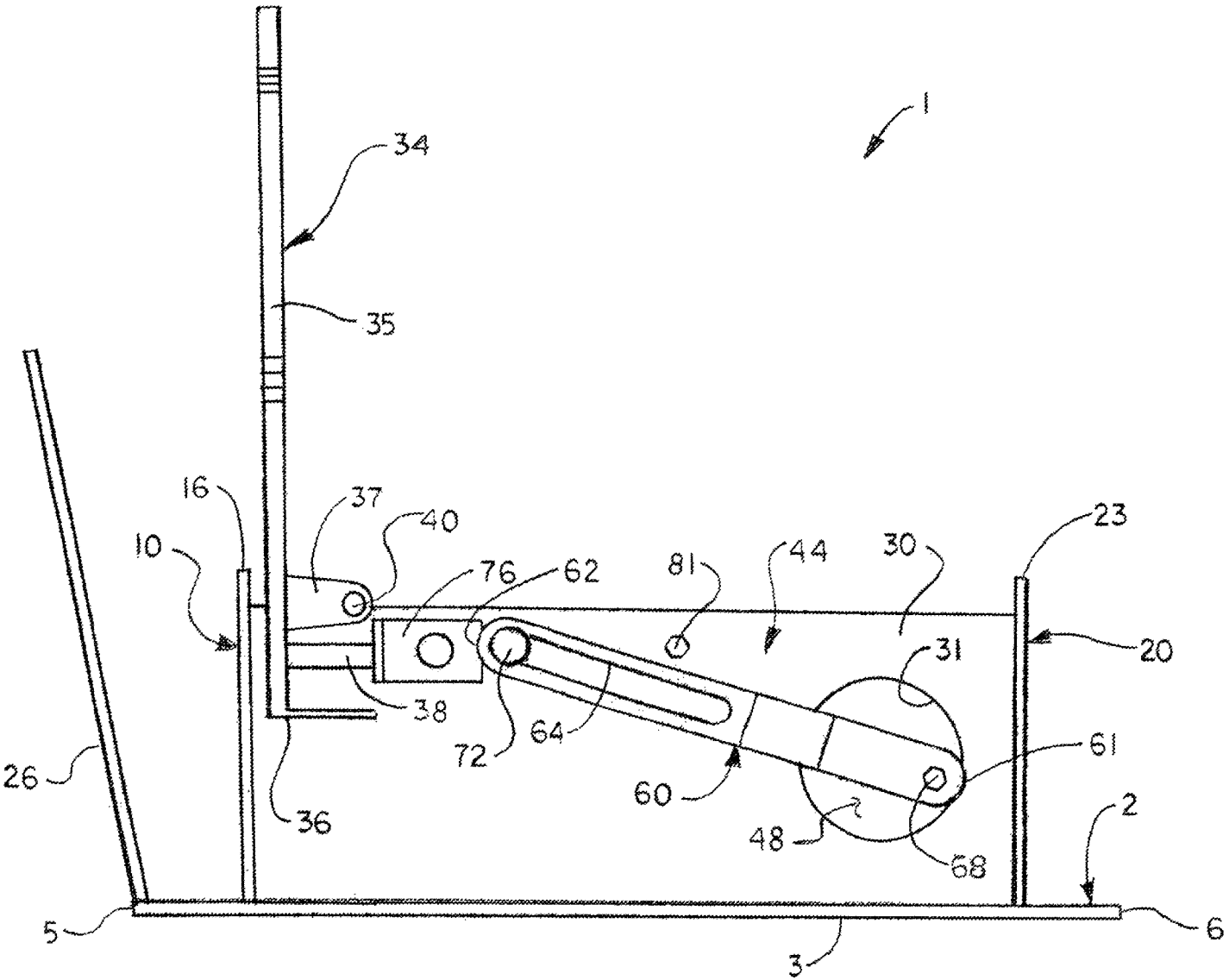
FIG. 6 is a left side view of the illustrative automated target system with the system cover removed and the target plate in the pre-struck position, more particularly illustrating a typical target return assembly suitable for returning the target plate from the post-struck position back to the pre-struck position.
Figure 7:
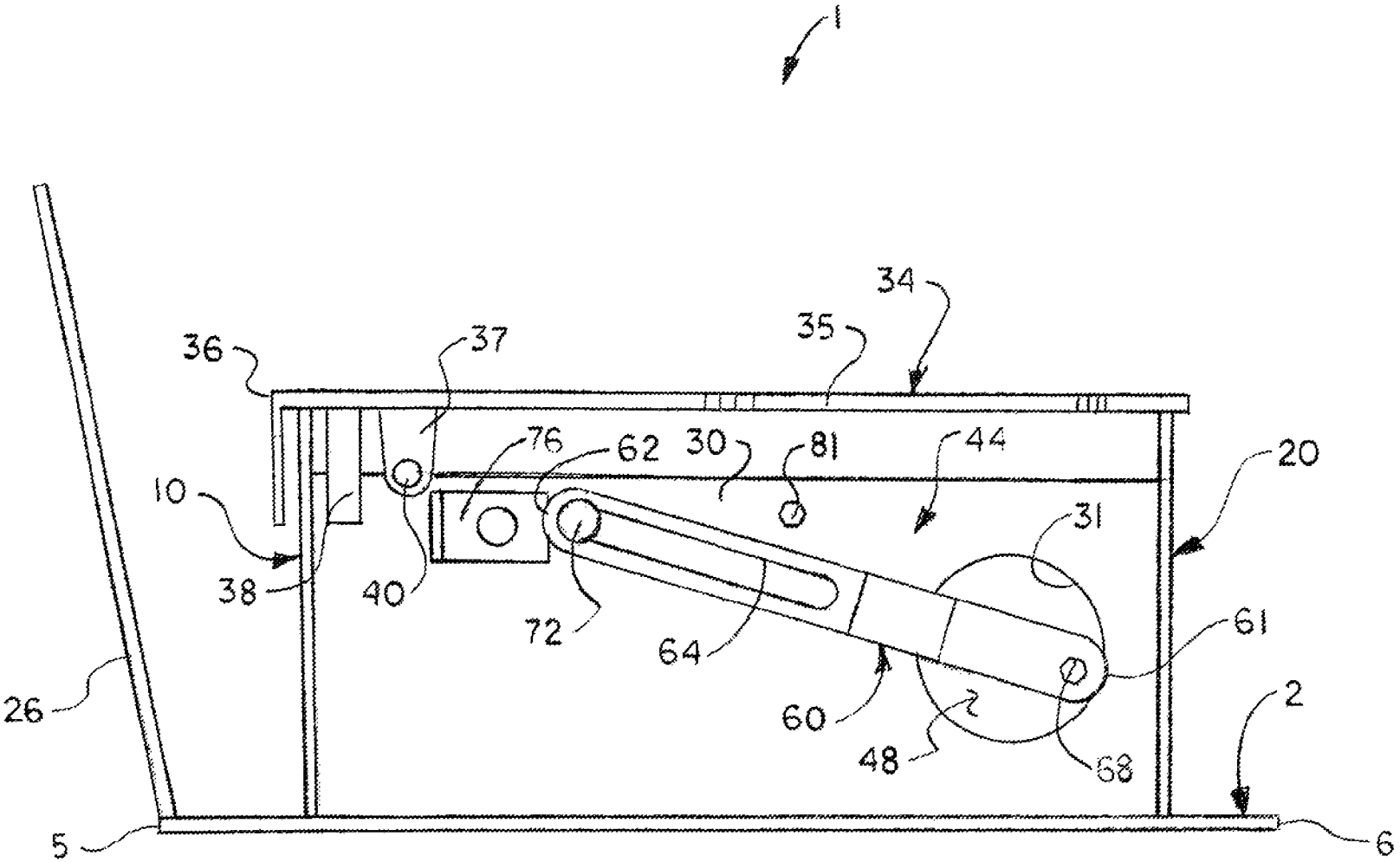
FIG. 7 is a left side view of the illustrative automated target system illustrated in FIG. 6 with the target plate in the post-struck position and the target return assembly deployed in a retracted home configuration.

In some embodiments, a target stop bracket 76 may be provided on the base partition 30. A target stop flange 38 may extend from the target portion 35 typically proximate the lower target portion edge 36. As illustrated in FIG. 6, in the erect position of the target plate 34, the target stop flange 38 may engage the target stop bracket 76 to prevent rearward pivoting of the target plate 34 on the system base 2.

Figure 11:
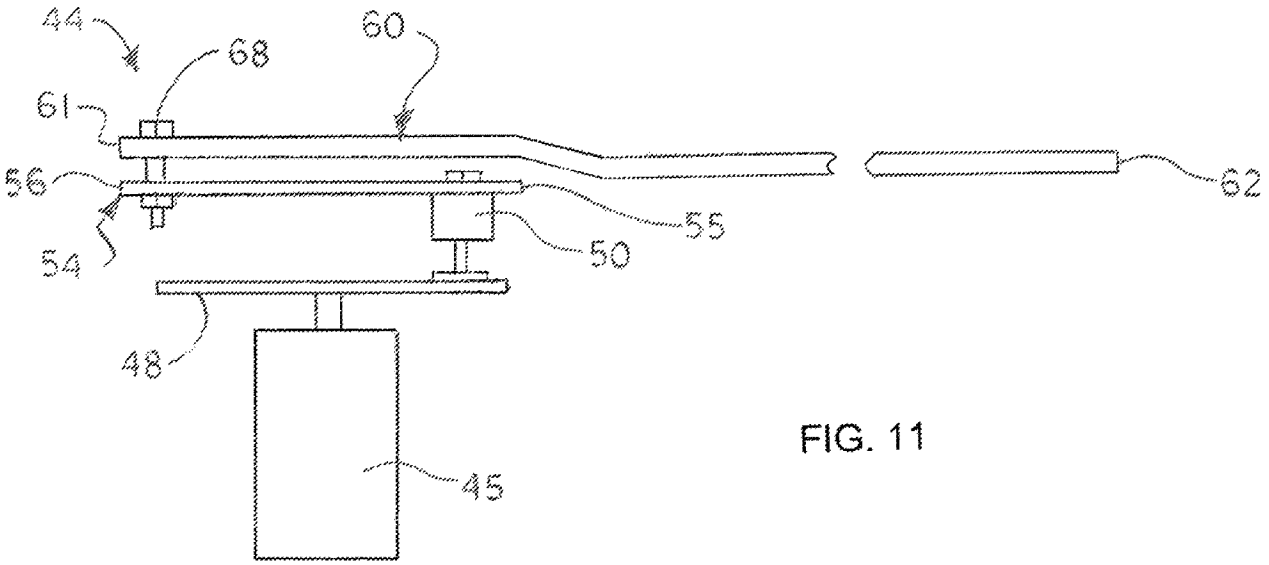
FIG. 11 is a top view, partially in section, of a typical target return assembly suitable for implementation of the automated target systems, with the target return assembly deployed in the retracted, home configuration.
Figure 12:
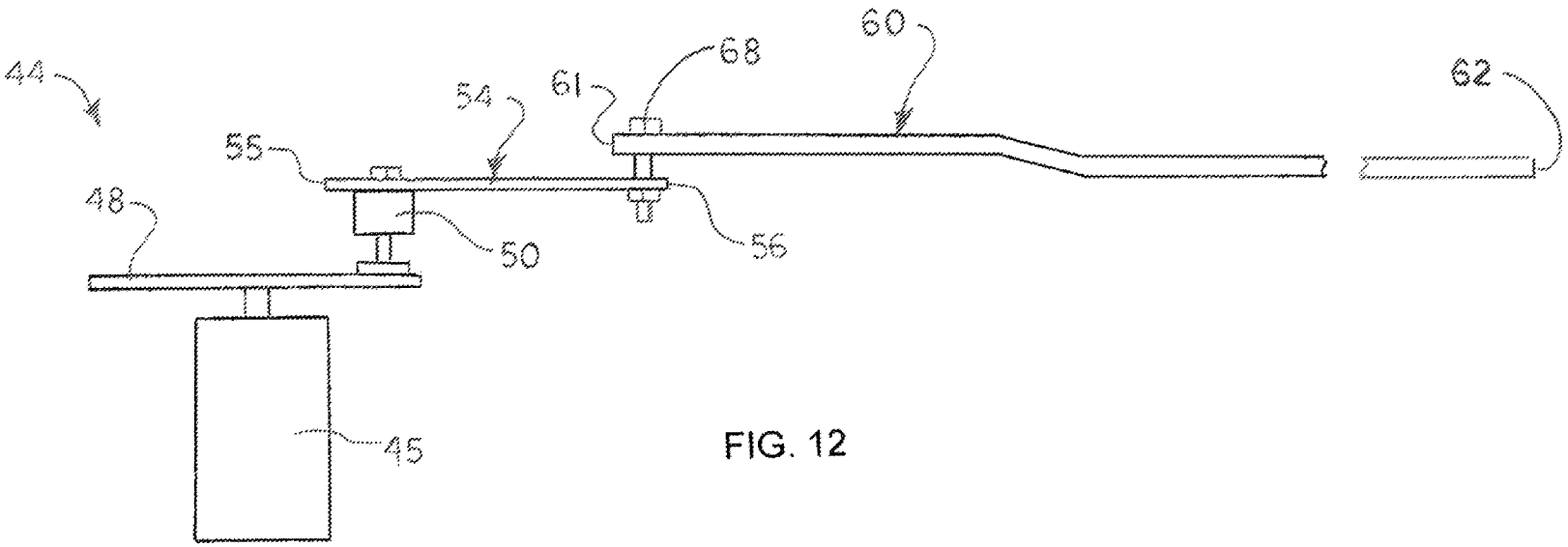
FIG. 12 is a top view of the target return assembly illustrated in FIG. 11, with the target return assembly deployed in the extended, target return configuration.

As illustrated in FIGS. 11 and 12, the target return assembly 44 may include a target return motor 45. A drive disk 48 may be drivingly engaged for rotation by the target return motor 45. An arm linkage 54 may have a proximal linkage end 55 rotatably engaged by the drive disk 48 in off-center relationship to the drive disk 48, typically via a linkage fastener 50, and a distal linkage end 56 opposite the proximal linkage end 55.

Figure 8:
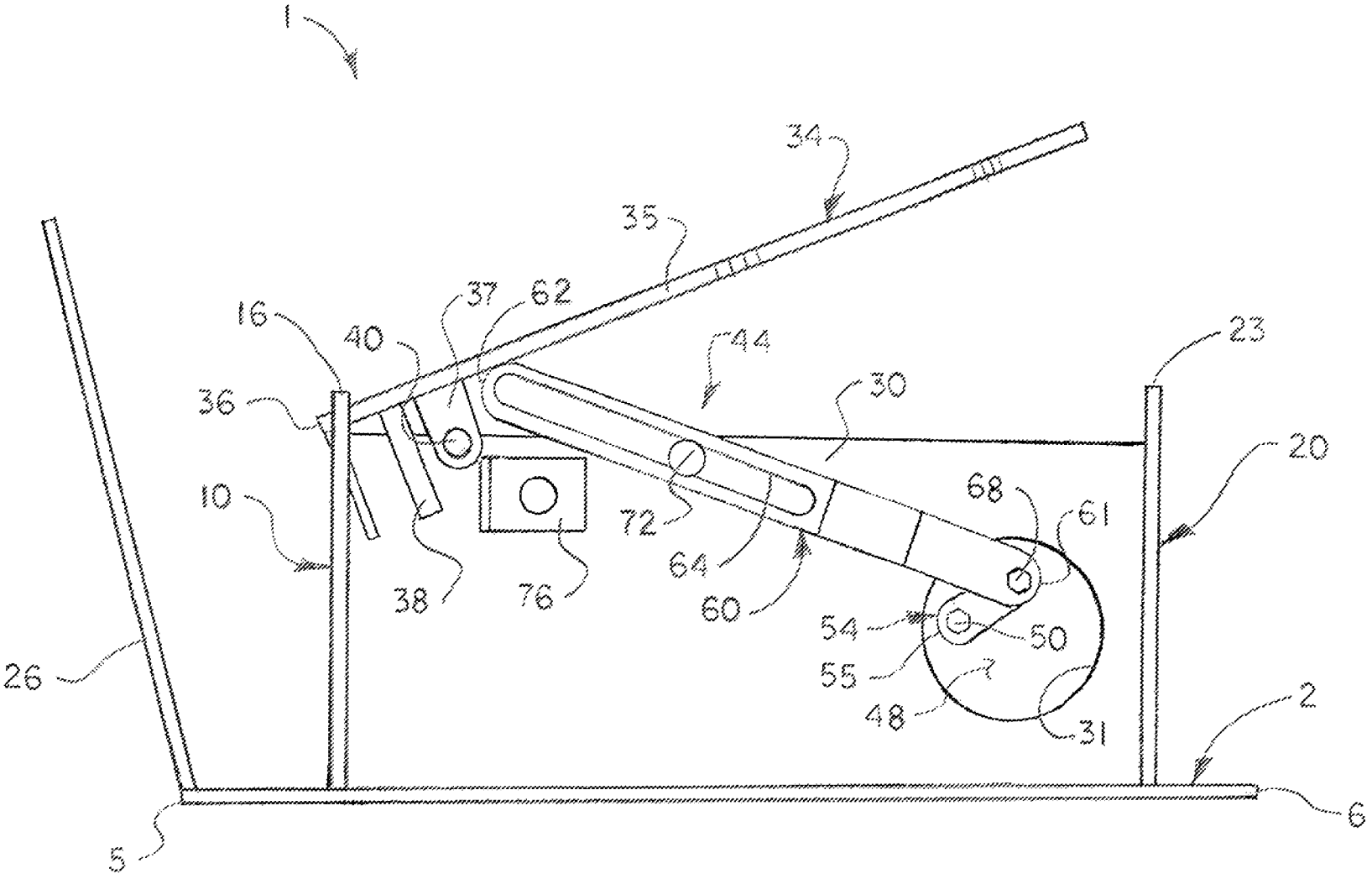
FIG. 8 is a left side view of the illustrative automated target system illustrated in FIG. 6 with the target return assembly engaging and returning the target plate from the post-struck position to the pre-struck position.
Figure 9:
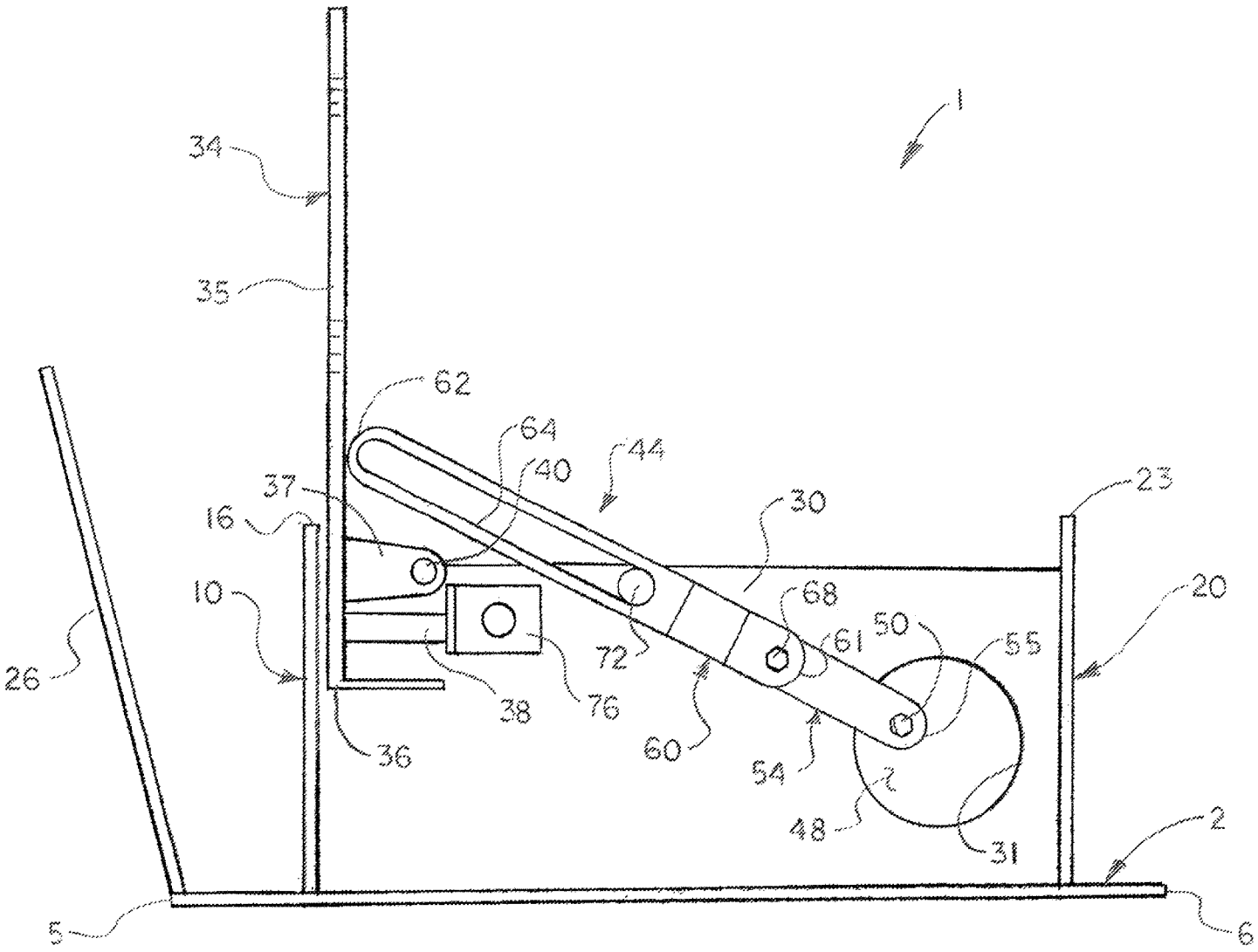
FIG. 9 is a left side view of the illustrative automated target system illustrated in FIG. 6 with the target return assembly in a fully extended, target return configuration upon return of the target plate to the pre-struck position.
Figure 10:
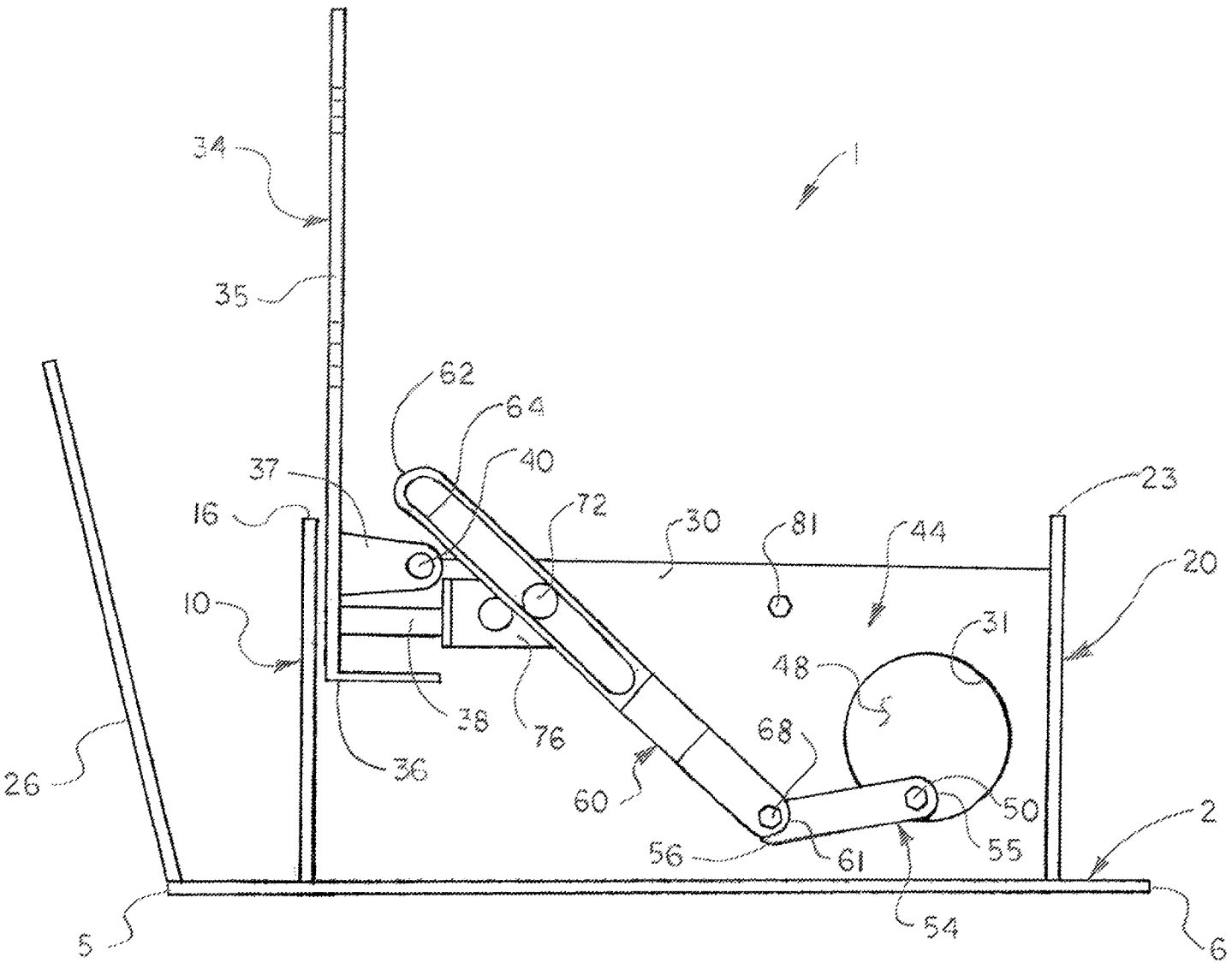
FIG. 10 is a left side view of the illustrative automated target system illustrated in FIG. 6 with the target plate remaining in the pre-struck position as the target return assembly returns from the target return configuration to the home configuration.

A target actuating arm 60 may have a proximal arm end 61 rotatably engaged by the arm linkage 54 at the distal linkage end 56, typically via an arm fastener 68, and a distal arm end 62 opposite the proximal arm end 61. Accordingly, the arm linkage 54 and the target actuating arm 60 may be configurable from a retracted home configuration (FIGS. 6 and 7) in which the distal arm end 62 of the target actuating arm 60 disengages the target plate 34 in the fallen, post-struck position thereof (FIG. 7) to a fully-extended target return configuration wherein the distal arm end 62 of the target actuating arm 60 engages and pushes the target plate 34 from the fallen, post-struck position to the erect, pre-struck position as illustrated in FIGS. 8 and 9, responsive to operation of the target return motor 45.

As illustrated in FIGS. 6-10, an elongated arm slot 64 may be provided in the target actuating arm 60. The arm slot 64 may extend from adjacent to the distal arm end 62 to a point which is substantially equidistant between the proximal arm end 61 and the distal arm end 62. At least one arm guide pin 72 may extend from the base partition 30 of the system base 2. The arm guide pin 72 may extend through the arm slot. Accordingly, as it traverses the arm slot 64, the arm guide pin 72 may constrain movement of the target actuating arm 60 as the target actuating arm 60 transitions between the home configuration and the target return configuration.

As illustrated in FIG. 1, at least one motion sensor 82 may be disposed in motion-sensing proximity to the target plate 34. At least one power supply 80, such as at least one battery, for example and without limitation, may electrically interface with the target return motor 45 of the target return assembly 44 through the motion sensor 82, typically via wiring 84.

The motion sensor 82 may be suitably positioned to sense movement of the target plate 34 as the target plate 34 transitions from the upright, pre-struck position to the fallen, struck position on the system base 2. For example and without limitation, as illustrated in FIG. 1, in some embodiments, the motion sensor 82 may be provided on the front base panel 10 of the system base 2 adjacent to the lower target portion edge 36 of the target plate 34. The motion sensor 82 may be configured to activate the target return motor 45 by establishing flow of electrical current from the power supply 80 to the target return motor 45 upon sensing movement of the target plate 34. Accordingly, the target return motor 45 may be configured to responsively actuate the target return assembly 44 from the retracted home configuration (FIG. 7) to the fully extended, target return configuration (FIG. 9) such that the target plate 34 is pivoted from the post-struck position back to the pre-struck position.

The power supply 80 may be provided in any suitable location on the system base 2. In some embodiments, the power supply 80 may be situated on the base plate 3 adjacent to or against the base partition 30 of the system base 2. At least one power supply fastener 81 may fasten the power supply 80 to the base partition 30, as illustrated, to the base plate 3 and/or to any other element of the system base 2.

Figure 4:
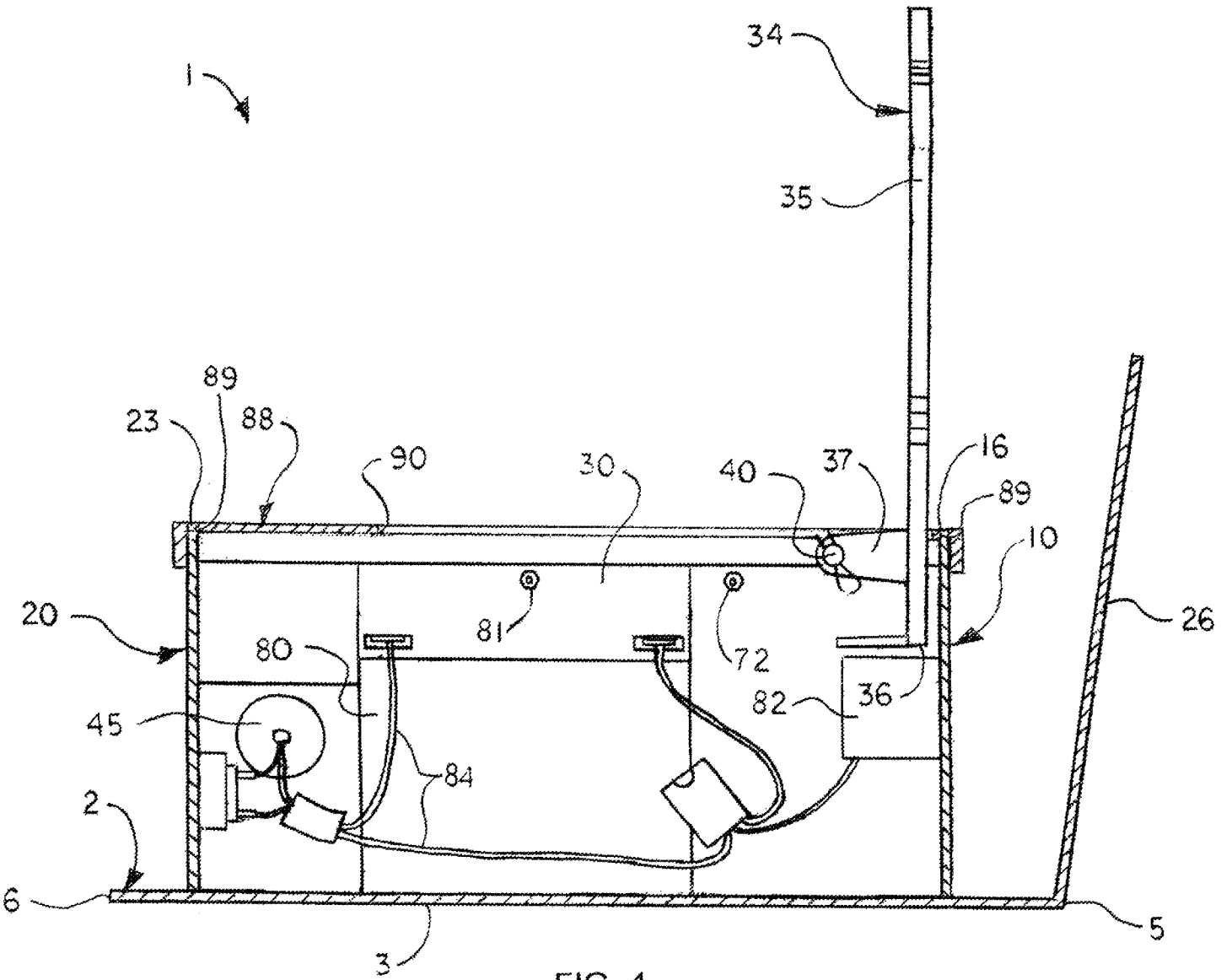
FIG. 4 is a longitudinal sectional view, taken along section lines 4-4 in FIG. 3, of the illustrative automated target system with the target plate in the pre-struck position.
Figure 5:
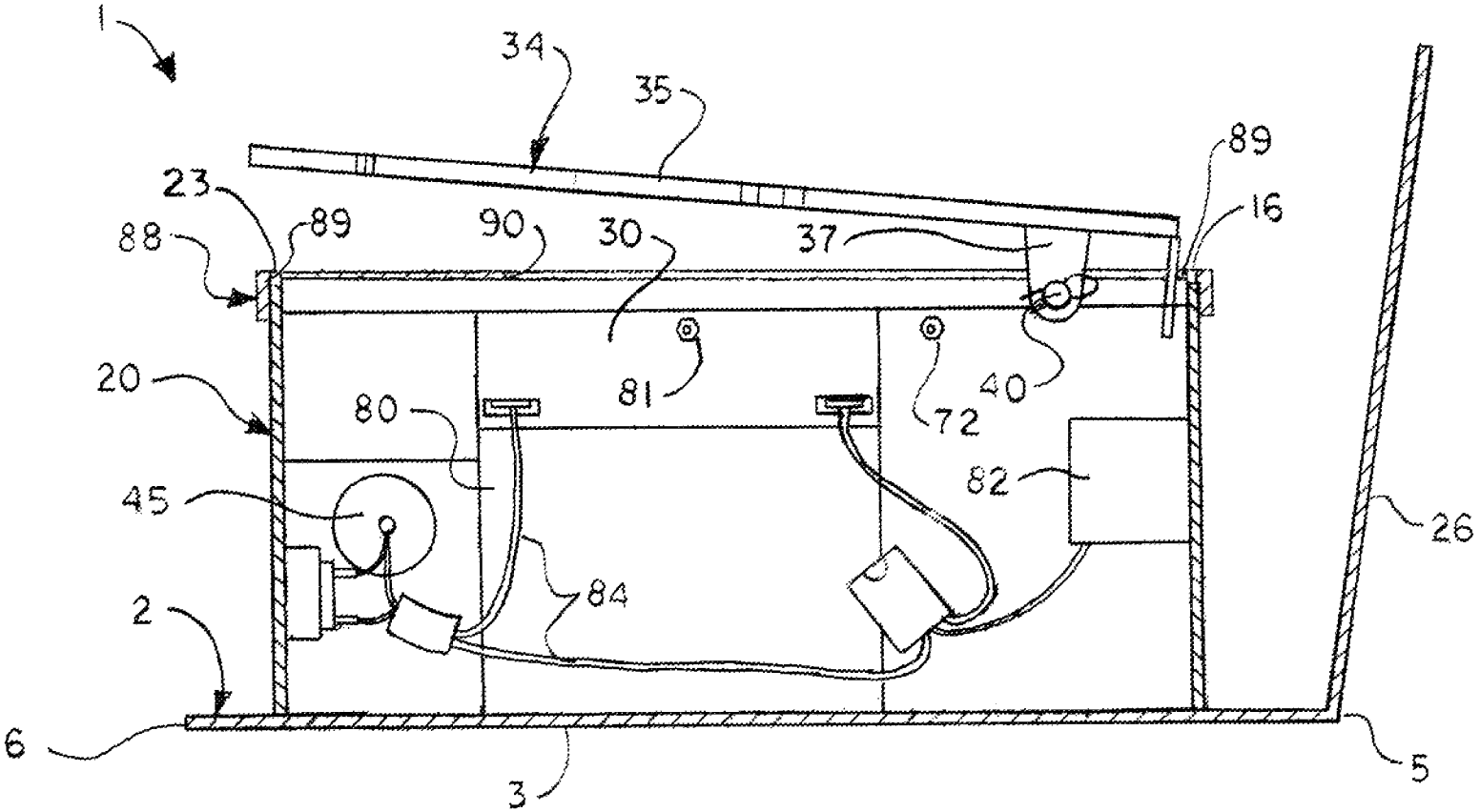
FIG. 5 is a longitudinal sectional view, also taken along section lines 4-4 in FIG. 3, of the illustrative automated target system with the target plate in a fallen, post-struck position.

As illustrated in FIGS. 3-5, in some embodiments, a system cover 88 may be provided on the system base 2. In some embodiments, the system cover 88 may include a cover top panel 91. A pair of cover side panels 92 may extend from the cover top panel 91. The cover side panels 92 may be suitably configured to reach and engage the respective side plate edges 4 of the base plate 3 of the system base 2 upon deployment of the system cover 88 in place on the system base 2.

A cover slot 90 may extend through the cover top panel 91. The cover slot 90 may have a size and shape which is sufficient to accommodate passage of at least a portion of the target plate 34 as the target plate 34 transitions between the pre-struck and struck positions.

In some embodiments, tab slots 89 may extend through the cover top panel 91 typically at or adjacent to the respective corners thereof. The tab slots 89 may be suitably positioned and configured to receive the respective front panel tabs 16 on the front base panel 10 and rear panel tabs 23 on the rear base panel 20 (FIG. 1) in deployment of the system cover 88 on the front base panel 10 and the rear base panel 20 of the system base 2.

In some embodiments, at least one tab opening (not illustrated) may extend through each front panel tab 16 and each rear panel tab 23. Accordingly, a lock or other cover retaining device (not illustrated) may be extended through each tab opening to retain the system cover 88 on the system base 2.

In typical application of the automated target system 1, the system base 2 may be placed flat on the ground or other surface (not illustrated). The target plate 34 may initially be deployed in the upright, pre-struck position illustrated in FIGS. 1-4. As illustrated in FIG. 6, the target actuating arm 60 of the target return assembly 44 may initially be configured in the retracted home configuration.

As he or she stands at a distance in front of the deflection panel 26, a shooter (not illustrated) aims a firearm toward the erect target plate 34 and discharges the firearm in an attempt to strike the target plate 34. In the event that the fired round strikes the target plate 34, the momentum of the projectile causes the target plate 34 to pivot from the erect, pre-struck position to the fallen, post-struck position illustrated in FIGS. 5 and 7. Accordingly, the motion sensor 82 senses movement of the target plate 34 as the target plate 34 falls to the post-struck position. The motion sensor 82 activates the target return motor 45, which rotates the drive disk 48. This action facilitates deployment of the target actuating arm 60 from the retracted home configuration illustrated in FIG. 7 to the extended, target return configuration, as illustrated in FIGS. 8 and 9.

As the target actuating arm 60 extends, the distal arm end 62 may engage the target plate 34, as illustrated in FIG. 8. Continued extension of the target actuating arm 60 returns the target plate 34 to the fully extended, upright pre-struck position illustrated in FIG. 9. The target return motor 45 may continue to rotate the drive disk 48 such that the arm linkage 54 returns the target actuating arm 60 back to the home position, as illustrated in FIG. 6. The target plate 34 is thus suitably deployed in the upright pre-struck position for another shooting attempt.

In the event that the trajectory of the fired round inadvertently falls below the horizontal level of the target plate 34, the round may strike the deflection panel 26. Accordingly, due to its downwardly angled configuration, the deflection panel 26 may deflect the round into the ground such that the round does not ricochet off the front base panel 10 toward the shooter.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. An automated target system, comprising:

a system base, wherein the system base comprises a base plate, a front base panel and a rear base panel extending from the base plat in spaced-apart relationship to each other and a base partition extending from the front base panel to the rear base panel, and wherein the target plate is pivotally carried by the front base panel;

a target plate pivotally carried by the system base, the target plate deployable in an erect, pre-struck position and a fallen, post-struck position;

a target return assembly engaging the target plate, the target return assembly including:

a target return motor;

a drive disk drivingly engaged for rotation by the target return motor;

an arm linkage having a proximal linkage end rotatably engaged by the drive disk in off-center relationship to the drive disk and a distal linkage end opposite the proximal linkage end;

a target actuating arm having a proximal arm end rotatably engaged by the arm linkage at the distal linkage end and a distal arm end opposite the proximal arm end, the arm linkage and the target actuating arm configurable from a retracted home configuration wherein the distal arm end of the target actuating arm disengages the target plate in the fallen, post-struck position to an extended target return configuration wherein the distal arm end of the target actuating arm engages and pushes the target plate from the fallen, post-struck position to the erect, pre-struck position responsive to operation of the target return motor;

an elongated arm slot in the target actuating arm; and at least one arm guide pin carried by the base partition of the system base, wherein the at least one arm guide pin extends through the arm slot;

at least one motion sensor disposed in motion-sensing proximity to the target plate; and at least one power supply electrically interfacing with the target return motor and the at least one motion sensor.

2. The automated target system of claim 1 further comprising a target plate notch in the front base panel, the target plate notch configured to receive the target plate in the fallen, post-struck position.

3. The automated target system of claim 1 further comprising a target mount bushing carried by the system base, a pair of spaced-apart target mount flanges carried by the target plate on opposite sides of the target mount bushing and a target pivot pin extending through the target mount flanges and the target mount bushing.

4. The automated target system of claim 1 further comprising a target stop bracket carried by the base partition and a target stop flange extending from the target plate, and wherein the target stop flange engages the target stop bracket in the erect, pre-struck position of the target plate.

5. The automated target system of claim 1 further comprising a system cover carried by the base.

6. The automated target system of claim 1 further comprising an angled deflection panel carried by the system base.

7. An automated target system, comprising:

a system base including:

a base plate;

a front base panel and a rear base panel extending from the base plate in spaced-apart relationship to each other;

a target plate notch in the front base panel;

a base partition extending upwardly from the base plate and spanning from the front base panel to the rear base panel;

at least one arm guide pin carried by the base partition of the base; and a partition opening extending through the base partition;

a target plate pivotally carried by the system base, the target plate deployable in an erect, pre-struck position and a fallen, post-struck position, wherein the target plate notch receives the target plate in the fallen, post-struck position;

a target return assembly engaging the target plate, the target return assembly including:

a target return motor carried by the base partition of the base-plate system base;

a drive disk drivingly engaged for rotation by the target return motor through the partition opening in the base partition;

an arm linkage having a proximal linkage end rotatably engaged by the drive disk in off-center relationship to the drive disk and a distal linkage end opposite the proximal linkage end;

a target actuating arm having a proximal arm end rotatably engaged by the arm linkage at the distal linkage end and a distal arm end opposite the proximal arm end, the arm linkage and the target actuating arm configurable from a retracted home configuration wherein the distal arm end of the target actuating arm disengages the target plate in the fallen, post-struck position to an extended target return configuration wherein the distal arm end of the target actuating arm engages and pushes the target plate from the fallen, post-struck position to the erect, pre-struck position responsive to operation of the target return motor; and an elongated arm slot in the target actuating arm, wherein the at least one arm guide pin extends through the arm slot;

at least one motion sensor disposed in motion-sensing proximity to the target plate; and at least one power supply electrically interfacing with the target return motor and the at least one motion sensor.

8. The automated target system of claim 7 further comprising a target mount bushing carried by the base partition, a pair of spaced-apart target mount flanges carried by the target plate on opposite sides of the target mount bushing and a target pivot pin extending through the target mount flanges and the target mount bushing.

9. The automated target system of claim 7 further comprising a target stop bracket carried by the base partition and a target stop flange extending from the target plate, and wherein the target stop flange engages the target stop bracket in the erect, pre-struck position of the of the target plate.

10. The automated target system of claim 7 further comprising a system cover carried by the base.

11. The automated target system of claim 10 wherein the system cover comprises a cover top panel, a pair of cover side panels extending from the cover top panel and a cover slot extending through the cover top panel.

12. The automated target system of claim 7 further comprising an angled deflection panel carried by the base in spaced-apart relationship to the front base panel.

13. An automated target system, comprising:

a system base including:

an elongated, rectangular base plate having a pair of elongated, parallel, spaced-apart side plate edges and a front plate edge and a rear plate edge extending between the side plate edges;

a front base panel extending from the base plate;

a target plate notch in the front base panel;

a pair of spaced-apart front panel tabs extending from the front base panel on respective sides of the target plate notch;

a rear base panel extending from the base plate in spaced-apart relationship to the front base panel;

a pair of spaced-apart rear panel tabs extending from the rear base panel;

a base partition extending upwardly from the base plate and spanning from the front base panel to the rear base panel;

a partition opening extending through the base partition;

an angled deflection panel carried by the base at the front plate edge and in spaced-apart relationship to the front base panel; and at least one arm guide pin carried by the base partition;

a target plate pivotally carried by the front base panel of the base, the target plate deployable in an erect, pre-struck position and a fallen, post-struck position, wherein the target plate notch receives the target plate in the fallen, post-struck position;

a target return assembly engaging the target plate, the target return assembly including:

a target return motor carried by the base partition of the base-plate system base;

a drive disk drivingly engaged for rotation by the target return motor through the partition opening in the base partition;

an arm linkage having a proximal linkage end rotatably engaged by the drive disk in off-center relationship to the drive disk and a distal linkage end opposite the proximal linkage end;

a target actuating arm having a proximal arm end rotatably engaged by the arm linkage at the distal linkage end and a distal arm end opposite the proximal arm end, the arm linkage and the target actuating arm configurable from a retracted home configuration wherein the distal arm end of the target actuating arm disengages the target plate in the fallen, post-struck position to a fully-extended target return configuration wherein the distal arm end of the target actuating arm engages and pushes the target plate from the fallen, post-struck position to the erect, pre-struck position responsive to operation of the target return motor; and an elongated arm slot in the target actuating arm, wherein the at least one arm guide pin extends through the arm slot;

a system cover carried by the front base panel and the rear base panel of the base, the system cover including a cover top panel, a pair of cover side panels extending from the cover top panel and a cover slot extending through the cover top panel;

at least one motion sensor carried by the front base panel of the system base, the at least one motion sensor disposed in motion-sensing proximity to the target plate; and at least one power supply electrically interfacing with the target return motor and the at least one motion sensor.

14. The automated target system of claim 13 further comprising a target mount bushing carried by the base partition, a pair of spaced-apart target mount flanges carried by the target plate on opposite sides of the target mount bushing and a target pivot pin extending through the target mount flanges and the target mount bushing.

15. The automated target system of claim 13 further comprising a target stop bracket carried by the base partition and a target stop flange extending from the target plate, and wherein the target stop flange engages the target stop bracket in the erect, pre-struck position of the of the target plate.

16. The automated target system of claim 13 further comprising a handle slot in the base plate between the front base panel and the deflection panel of the base.

* * * * *